US005259817A

United States Patent [19]

Schumacher et al.

[11] Patent Number: 5,259,817

[45] Date of Patent: Nov. 9, 1993

[54] DIFFUSER WITH CEILING-PENETRATING NOZZLES

[76] Inventors: Donald J. Schumacher, 2169 Salsiberry Ct.; William G. Fields, 455 Alt. 19 South, Apt. 149, both of Palm Harbor, Fla. 34683

[21] Appl. No.: 875,512

[22] Filed: Apr. 29, 1992

[51] Int. Cl.[5] ..... F24F 13/068

[52] U.S. Cl. ..... 454/296; 454/305

[58] Field of Search ..... 454/284, 286, 292, 296, 454/297, 298, 305

[56] References Cited

U.S. PATENT DOCUMENTS

| | | | |
|---|---|---|---|
| 4,726,285 | 2/1988 | Kelley | 454/246 X |
| 4,794,851 | 1/1989 | Kurrle | 454/305 |

FOREIGN PATENT DOCUMENTS

| | | | |
|---|---|---|---|
| 149203 | 7/1985 | European Pat. Off. | 454/305 |
| 164738 | 12/1985 | European Pat. Off. | 454/297 |
| 2457984 | 6/1976 | Fed. Rep. of Germany | 454/246 |
| 512426 | 9/1956 | Italy | 454/305 |
| 9114904 | 10/1991 | PCT Int'l Appl. | 454/284 |
| 164763 | 1/1934 | Switzerland | 454/305 |
| 916916 | 3/1982 | U.S.S.R. | 454/284 |
| 1161796 | 6/1985 | U.S.S.R. | 454/296 |

*Primary Examiner*—Harold Joyce

*Attorney, Agent, or Firm*—Joseph C. Mason, Jr.; Ronald E. Smith

[57] ABSTRACT

An air diffuser that injects triangular columns of air into a space to be air conditioned. The triangular columns of air entrain air into their wake and set up a cross flow of air in a direction normal to the path of travel of the air in the triangular columns. In a first embodiment, a plurality of elongate, triangular nozzles are disposed at an angle in penetrating relation to a ceiling so that a first end of each nozzle is above the plane of the ceiling and a second end of each nozzle is below the plane. A housing in fluid communication with a source of air to be introduced into the space is positioned above the ceiling in housing relation to the respective first ends of the nozzles so that air introduced into the housing under positive pressure is constrained to exit the housing through the nozzles. In second and third embodiments, the nozzles are of differing geometrical configurations in transverse section and do not penetrate the plane of the panel within which they are mounted. In a fourth embodiment, ceiling-penetrating nozzles are inverted relative to their first embodiment position.

6 Claims, 6 Drawing Sheets

DIFFUSER WITH CEILING-PENETRATING NOZZLES

BACKGROUND OF THE INVENTION

1. Field of the Invention

This invention relates to air diffusers of the type used in connection with air conditioning cooling and heating equipment.

2. Description of the Prior Art

Early air conditioning equipment delivered cooled air to a space to be cooled, but no attempt was made to enhance the diffusion of the cooled air throughout the space. Instead, it was believed that the natural cycle of cool air falling and warm air rising would be adequate to cool a space in an acceptable period of time.

Those skilled in the art of fluid dynamics observed, however, that substantial amounts of energy could be saved if the natural circulation of the air were enhanced by air diffusing equipment. As air diffusing equipment came into use, a performance index known as the air diffusion performance index was created to measure the efficiency of such equipment. As the air diffusion performance index of an air injection unit goes up, the comfort and indoor air quality produced in the conditioned space is improved.

It was eventually discovered that if the cooled air were formed into a fast flowing narrow stream of air, ambient air would be entrained into that fast flowing stream and air circulation within the space to be cooled would be enhanced. An example of that technology is disclosed in U.S. Pat. No. 4,876,949 to Fairchild et. al. A hollow housing having sidewalls is suspended from a ceiling, and rows of circular openings are formed in the sidewalls so that a stream of air can escape from each opening. The sidewalls are oblique to a vertical plane so that each stream of air is directed downwardly into the space to be cooled.

Although the Fairchild et. al. approach enhances air circulation and thus performs its intended function, it does have a few drawbacks. The housing is somewhat expensive because it requires a large amount of material. Moreover, although ambient air is entrained into the cylindrical streams of air flowing from the circular openings, the amount of entrainment is not optimal. The amount of entrainment is not optimal for two reasons. First of all, the angle at which the columns of air are injected is not optimal. Moreover, the cylindrical or columnar shape of the injected air is also not optimal. Thus, the air diffusion performance index of the Fairchild system is not optimal.

Despite these drawbacks, air injectors of the Fairchild et. al. type remain attractive because of the substantial energy savings they provide. The columns of air injected into the space, due to their rapid movement and the concomitant entrainment of air into their respective wakes, may be of low volumetric extent, i.e., a small amount of fast moving cold air can lower the temperature of a space more efficiently than a slower moving volume of warmer air having a greater volumetric extent. Larger fans, coils, filters, ducts, and other related equipment are required to produce larger volumes of cool air, of course. Thus, if a space can be cooled with less cool air, then substantial savings can be realized. Smaller fans, coils, filters, ducts, and related equipment cost less to manufacture and cost less to operate since they consume smaller quantities of energy.

What is needed, then, is a diffuser that uses less material in its construction, and that entrains greater amounts of air. Specifically, the art awaits development of a diffuser having a substantially enhanced air diffusion performance index so that even greater energy savings can be realized while maintaining higher indoor air quality.

At the time the present invention was made, the prior art, considered as a whole in accordance with the requirements of law, neither taught nor suggested to those of ordinary skill in the diffuser arts how the desired objectives could be obtained.

SUMMARY OF THE INVENTION

The present invention eliminates the housing of the diffusers of the prior art, thereby eliminating the expense of fabrication associated therewith. Moreover, it provides greater entrainment of air; thus, it has a substantially higher air diffusion performance index than the diffusers heretofore known.

The novel diffuser apparatus has utility in diffusing warmed air throughout a space being heated as well.

In a first embodiment, the primary structural element of the novel diffuser is an elongate hollow nozzle that is triangular in transverse section. A plurality of the nozzles may be arrayed in any configuration, but in most applications they will be arrayed in two adjacent, parallel rows and the nozzles of each row will point in a common direction opposite to the direction toward which point the nozzles of the other row. Each nozzle is tilted at a common angle relative to a horizontal plane (for ceiling or floor mounts; the mounting angle is relative to a vertical plane for wall mounts) so that cool or warm air flowing therethrough is injected downwardly into the space to be warmed or cooled. The initial path of travel of the air, then, is downwardly at that angle. However, after said air has traversed a short distance (less than a foot), its path of travel bends upwardly and it then flows along the ceiling; this phenomenon is known as the Coanda effect.

In said first embodiment, each nozzle penetrates the plane of the ceiling of the space being treated; thus a first or leading end of each nozzle is positioned above the plane of the ceiling and a second or trailing end of each nozzle is positioned below said plane. All of the leading ends of the nozzles are housed within an insulated housing that is in open fluid communication with a duct that supplies cold or warm air from the coils of a conventional heating system, or cold air from a conventional air conditioning system. This insulated housing is positioned above the plane of the ceiling as aforesaid and thus condensate does not form upon it. The air from the duct enters the hollow housing and is constrained to exit therefrom through the nozzles. As the air flows through each nozzle, it is constrained to conform to the shape of the interior sidewalls of each nozzle, of course. Thus, each nozzle injects into the air of the space being conditioned a column of air that is triangular in transverse section.

In a second embodiment of the invention, the triangular nozzles extend below the plane of the ceiling, but not above said plane. This substantially reduces the materials needed to make the nozzles.

Unlike the cylindrical columns of air of the prior art, the triangular columns have an ideal shape. The present inventors have discovered that maximum air entrainment occurs when the ratio of the surface area of the diffusing element to the cross sectional area thereof is maximized. Specifically, a cylindrical diffusing element will have a surface area of D1 and a cross sectional area of $r^2$. The ratio of D1: $r^2$ is not optimal. The triangular diffusing elements of this invention, on the other hand, have a surface area equal to three times the width times length of each side of the triangle (3B1 for a nozzle having the cross section of an equilateral triangle) and the cross sectional area thereof is ½ base times height. The ratio of 3B1:1/2BH is about twice that of D: $r^2$. Moreover, the ratio of the nozzle length to cross sectional area should be 3:1 or greater to establish non turbulent linear air flow within the tube and to prevent diffusion at its outlet. Also the base of the triangular shaped airjet forms a flat surface adjacent to the ceiling. This flat surface has a greater affinity for the low pressure region created between the ceiling and the upper surface of the air jet than other shapes. The Coanda effect is strengthened by this affinity, allowing greater turn down or throttling rates than has previously been possible.

The novel diffusing elements of the present invention are also positioned at an angle that has been determined to be optimal (eleven degrees relative to a horizontal plane). Thus, the optimal geometric shape of the novel diffusing elements and their optimal angular orientation provide an air diffuser having an unsurpassed efficiency. This increased efficiency not only lowers energy bills, it also enhances indoor air quality.

The optimum angular placement of the novel diffusing elements and the optimal geometric structure thereof have an unexpected benefit as well. Formation of condensate on diffusing elements has long been a problem; if condensate forms rapidly, it drips into the space being cooled, and such dripping is unacceptable. This problem is minimized in the present invention because a secondary air flow, more fully described hereinafter, brings warm room air into contact with the exposed part of the diffusing elements, thereby warming its surface and inhibiting condensation formation thereon.

Mathematical modeling and laboratory tests have proven that the application of at least five scientific principles are necessary to accomplish optimum ambient air entrainment. First, the injected airstream must have adequate velocity and mass to provide sufficient momentum to cause desired circulation, entrainment and mixing of the ambient air. Second, the ratio of peripheral surface area to cross sectional area must be high to provide maximum potential contact between the two air masses. Third, the ratio of the longitudinal dimension to cross sectional area of the nozzle should be 3:1 or greater. This establishes nonturbulent, linear flow within the tube which prevents diffusion of the air jet when it exits the nozzle, thereby allowing the airjet to continue in its triangular form for some distance into the conditioned room. Fourth, adequate space must be provided around the perimeter of each air shaft as to allow maximum contact of the injected airstream with the ambient air. Fifth, the jet stream must be projected at a specific angle away from the surface it is flowing across, thereby creating a negative pressure region between the high velocity jet and that surface. The low pressure region created must be of sufficient depth and intensity so as to cause ambient air to flow into it, thus enhancing ambient air entrainment. The invention herein described embodies all five of these principles to a higher degree than has previously been possible.

The novel diffuser is unique in that it projects air away from the panel within which it is mounted, allowing a low pressure region to occur for a short distance. The triangular shaped airstream is then attracted back towards the ceiling or wall. This eliminates the tendency of the cold air stream to sink or drop into the conditioned room causing objectionable drafts. The diffuser accomplishes this task, due to its unique shape and introduction angle, to a greater extent than heretofore possible. This allows turn down or throttling rates heretofore unobtainable.

In a third embodiment, the nozzles extend at a predetermined angle relative to the ceiling, floor, or wall panel within which they are mounted, but the transverse cross sectional shapes thereof are of any predetermined geometrical configuration such as circular, elliptical, square, and the like.

A fourth embodiment is similar to the first, but the nozzles are inverted with respect to their first embodiment positions.

The primary object of this invention is to advance the art of diffusers in general and more particularly those used in air conditioning or heating systems so that energy may be conserved. A more specific object is to provide a diffuser that reduces energy consumption by rapidly mixing cool or warm air with warmer or cooler air, respectively.

Another object is to provide a diffuser having no condensate formation problem.

Additional objects are to provide a diffuser apparatus that is flexible in design and economical to manufacture so that the cost of installing the apparatus is lowered.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
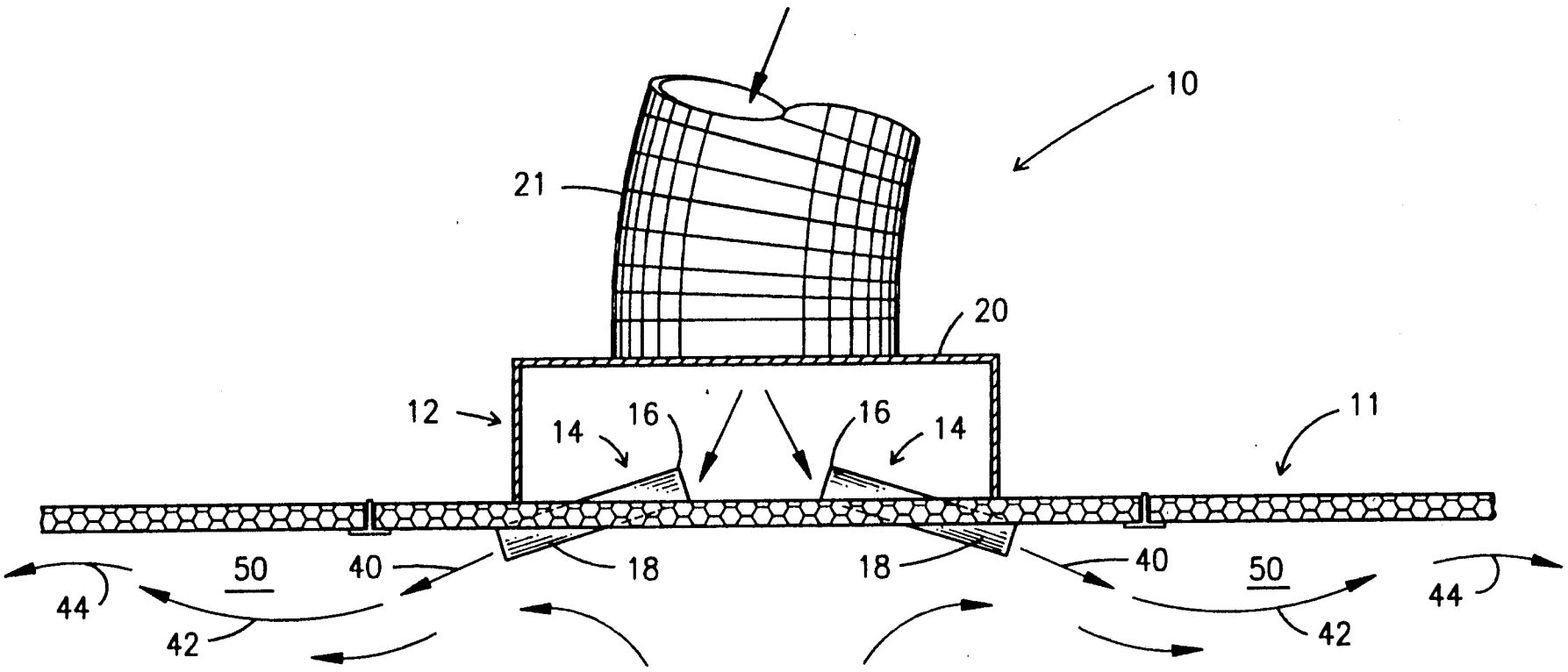
FIG. 1 is a sectional, side elevational view of the novel air injection unit.

Referring now to FIG. 1, it will there be seen that a first embodiment of the novel air diffuser and a typical environment is denoted as a whole by the reference numeral 10. Ceiling 11 forms no part of the invention, of course, but is shown to disclose how the novel diffuser 12 is mounted therein. The diffuser could also be mounted in a wall or floor. Accordingly, in the claims that follow, the term "ceiling means" or "panel member" shall be construed as including ceilings, walls, floors, and the like. Diffuser 12, theoretically at least, could include a single diffusing element or nozzle member 14, but as a practical matter most installations will require a plurality of such nozzle members; accordingly, the nozzle members are collectively denoted 14.

Each nozzle member 14 is tilted at a predetermined angle relative to the horizontal plane occupied by ceiling 11. Thus, a first or leading end 16 of each nozzle 14 is positioned above the plane of the ceiling and the second or trailing end 18 of each nozzle is positioned below said plane. The optimal angle of inclination is believed to be about eleven degrees relative to said horizontal plane.

It is important to note that this heretofore unknown arrangement of parts eliminates the below-the-ceiling housing of the prior art. As mentioned earlier, this eliminates the expense of fabricating the housing.

The leading end 16 of each nozzle is housed within housing 20 which is also positioned above the plane of the ceiling 11 (or below the plane of a floor, or behind the plane of an upstanding wall, as applicable). Housing 20 is in open fluid communication with an air conditioning duct 21 that delivers cold air thereto when an air conditioning system, not shown, is in its cooling mode and that delivers warm air thereto when in its heating mode. The walls of housing 20 are imperforate so that the air delivered thereto by said duct 21 is constrained to exit from said housing through the nozzle members. Thus, the air in housing 20 is under positive pressure when the system is operating; accordingly, housing 20 may be referred to as a plenum chamber.

Figure 4:
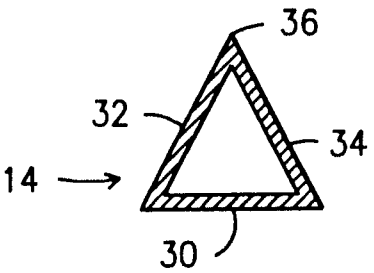
FIG. 4 is a transverse sectional view of one of the nozzles.

In this first embodiment, and as perhaps best shown in FIG. 4, each nozzle 14 has a flat bottom wall 30 and sidewalls 32, 34. Since walls 30, 32 and 34 have a common width or transverse extent, the triangle collectively formed by said walls is an isosceles triangle. However, other geometric configurations are within the scope of this invention. For example, cylindrical nozzles, (i.e., nozzles that are circular in transverse section), mounted in the novel manner disclosed herein will also provide many of the benefits realized by this invention, although it is believed that cylindrical columns of air entrain lower volumes of air in their wake than the preferred triangular columns of air due to the lower ration of peripheral extent to cross sectional area, as mentioned earlier.

Figure 2:
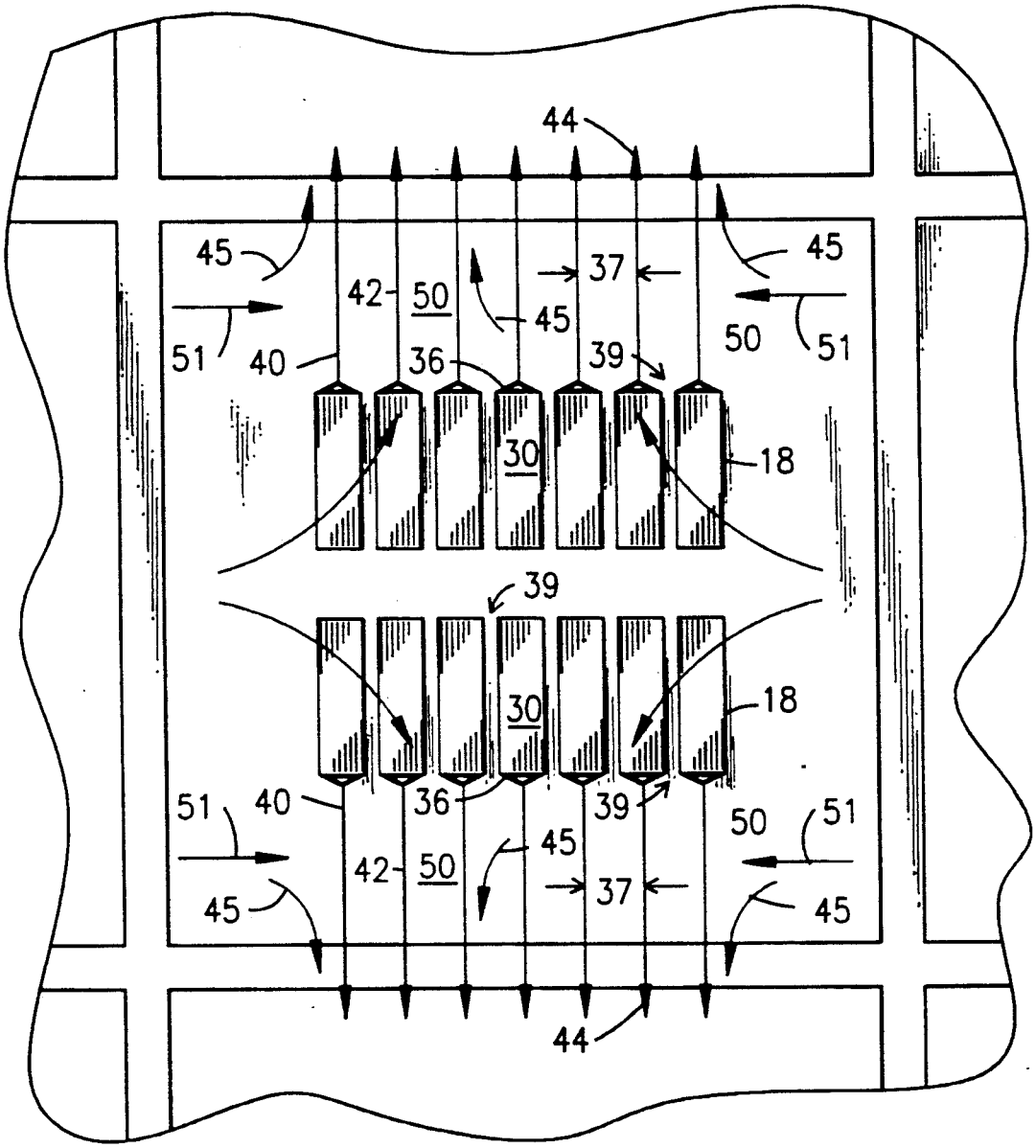
FIG. 2 is a bottom plan view thereof.
Figure 3:
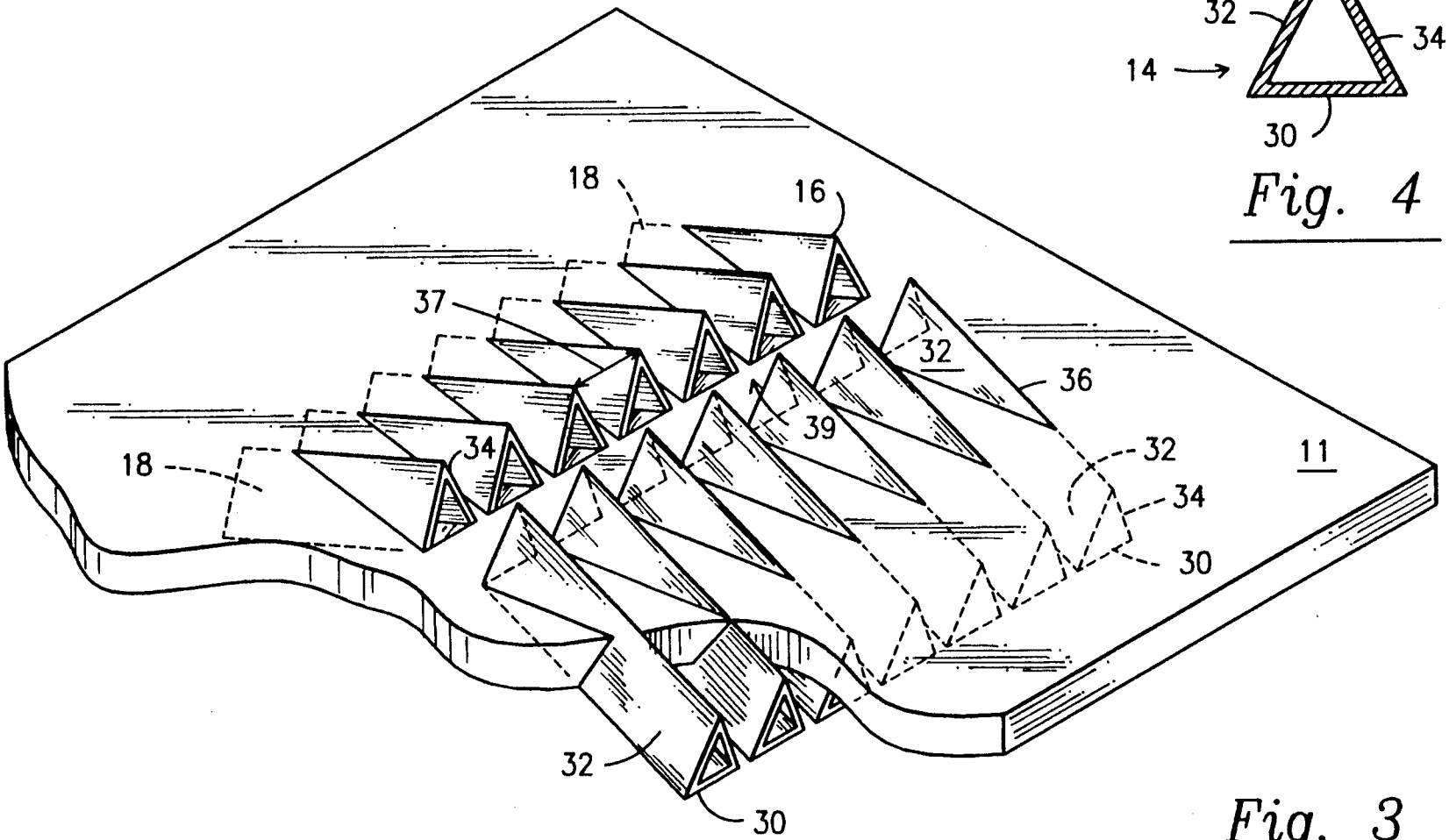
FIG. 3 is a perspective view thereof, when viewed from above the plane of the ceiling, and with the housing removed to better show the nozzles.

The apex of each triangle formed is collectively denoted 36; note in FIGS. 2 and 3 that the space 37 between contiguous apexes 36 is greater than the space 39 between contiguous bottom walls 30. This ensures that each triangular column of air is independent of its adjacent columns, i.e., each column is sufficiently spaced from its contiguous columns so that each column entrains ambient air not entrained by said contiguous columns.

The unique air flow pattern or path of travel created by all embodiments of the novel apparatus is depicted in FIGS. 1 and 2. As shown in FIG. 1, the initial downwardly directed part of the path of travel of the triangular columns of air is denoted 40. As the downwardly flowing air encounters the large air mass in the space being conditioned, said downwardly flowing air is attracted back up towards the ceiling as at 42; thereafter, it flows along the ceiling as at 44. This path of travel is due t the aforementioned Coanda effect. Directional arrows 45 in FIG. 2 show the air entrained in the wake of the triangular columns of air as said columns follow said path of travel; this is the primary path of travel.

A low pressure area, generally denoted 50 in FIGS. 1 and 2, is created between ceiling 11 and the above-described primary path of travel. Accordingly, air is drawn into said low pressure area, as indicated by the directional arrows 51 in FIG. 2; this is the secondary path of travel. Note that airflow 51 is normal to airflow 45. Thus, the novel apparatus establishes the world's first airflow pattern having perpendicular paths of travel; this substantially enhances the mixing of the air being conditioned with the conditioning air and results in a substantial energy saving as well as a substantially lowered system installation cost.

This secondary airflow 51 also delivers warm air to nozzles 14 so that condensate does not form on them.

An air conditioning or heating system made in connection with the novel air injection unit of this invention may have fans, coils, filters, ducts, and related parts that are smaller and which consume less energy than the corresponding parts of the prior art. For example, smaller fans, air handling units, cooling coils, air filters, supply air ducts, mechanical equipment rooms and the like are all made possible by the breakthrough herein disclosed.

Figure 6:
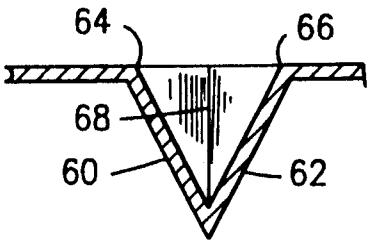
FIG. 6 is a sectional view taken along line 6—6 in FIG. 5.
Figure 7:
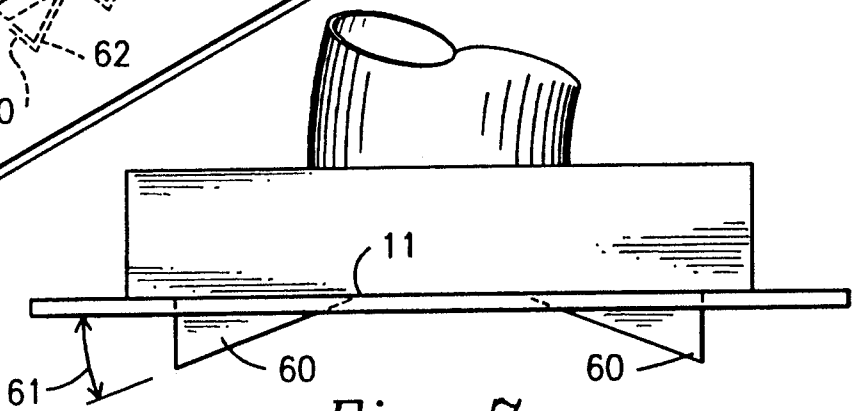
FIG. 7 is a side elevational view of said second embodiment.
Figure 5:
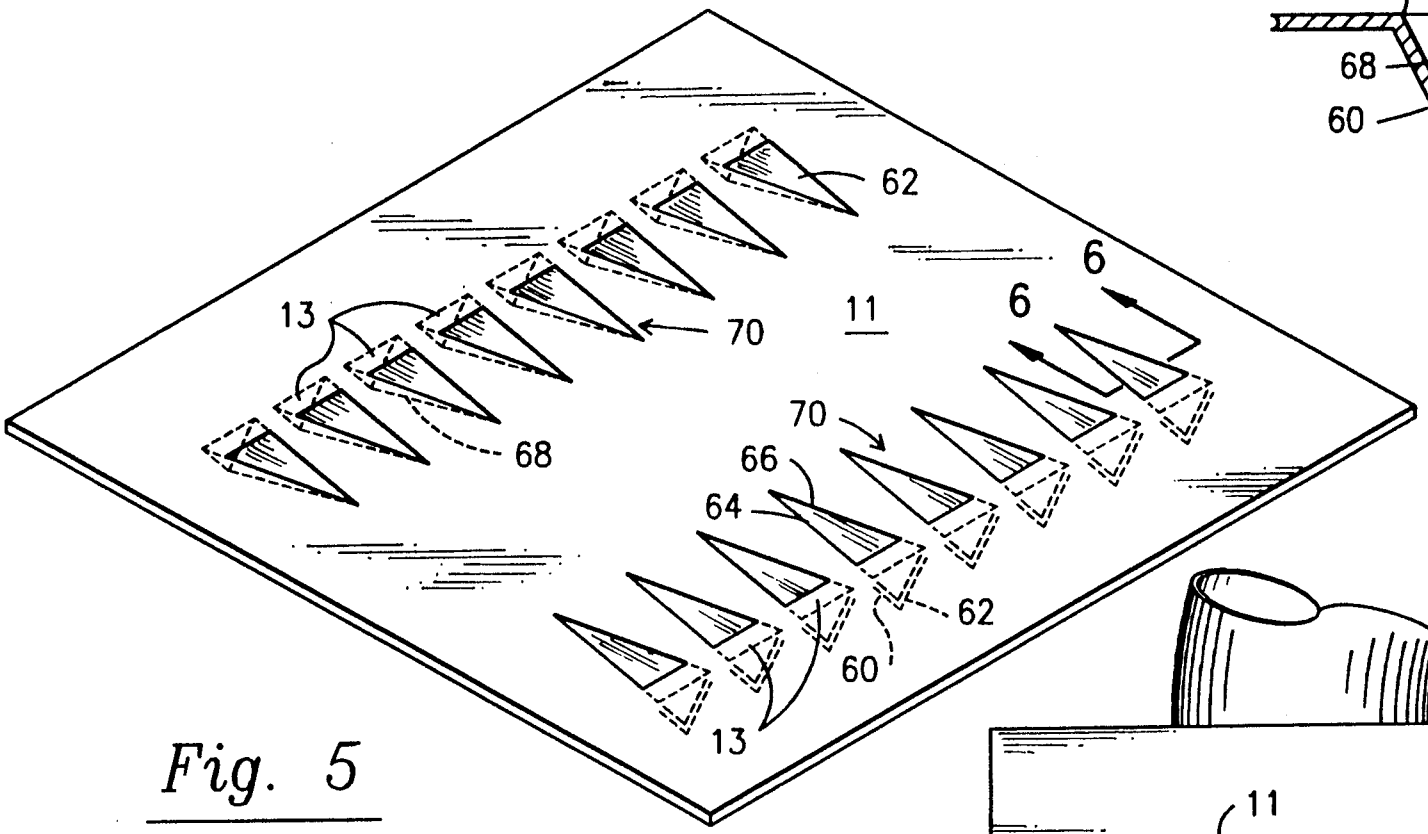
FIG. 5 is a perspective view of the second embodiment.

In a second embodiment, depicted in FIGS. 5–7, the nozzles do not penetrate the plane of ceiling 11 or other wall or floor panel. Thus, a substantial savings in materials is realized because all parts above the plane of the ceiling (or behind or below the wall or floor panel, respectively) are eliminated. Note also that the nozzles of this second embodiment are formed of two flat, converging sidewalls 60, 62 that depend from opposite edges 64, 66, respectively, of a triangular opening 70 formed in ceiling 11. Sidewalls 60, 62 meet at an elongate apex 68 that extends downward from the plane of said ceiling at a predetermined angle, preferably about eleven degrees. It should therefore be understood that each sidewall 60, 62 has the shape of a right triangle, as best shown in FIG. 7.

Note in FIG. 5 that each opening 70 is preferably blanked off as at 13. In a preferred embodiment, the longitudinal extent of blank off plate 13 is about one-half inch; this provides definition to the triangular column of air.

Figure 8:
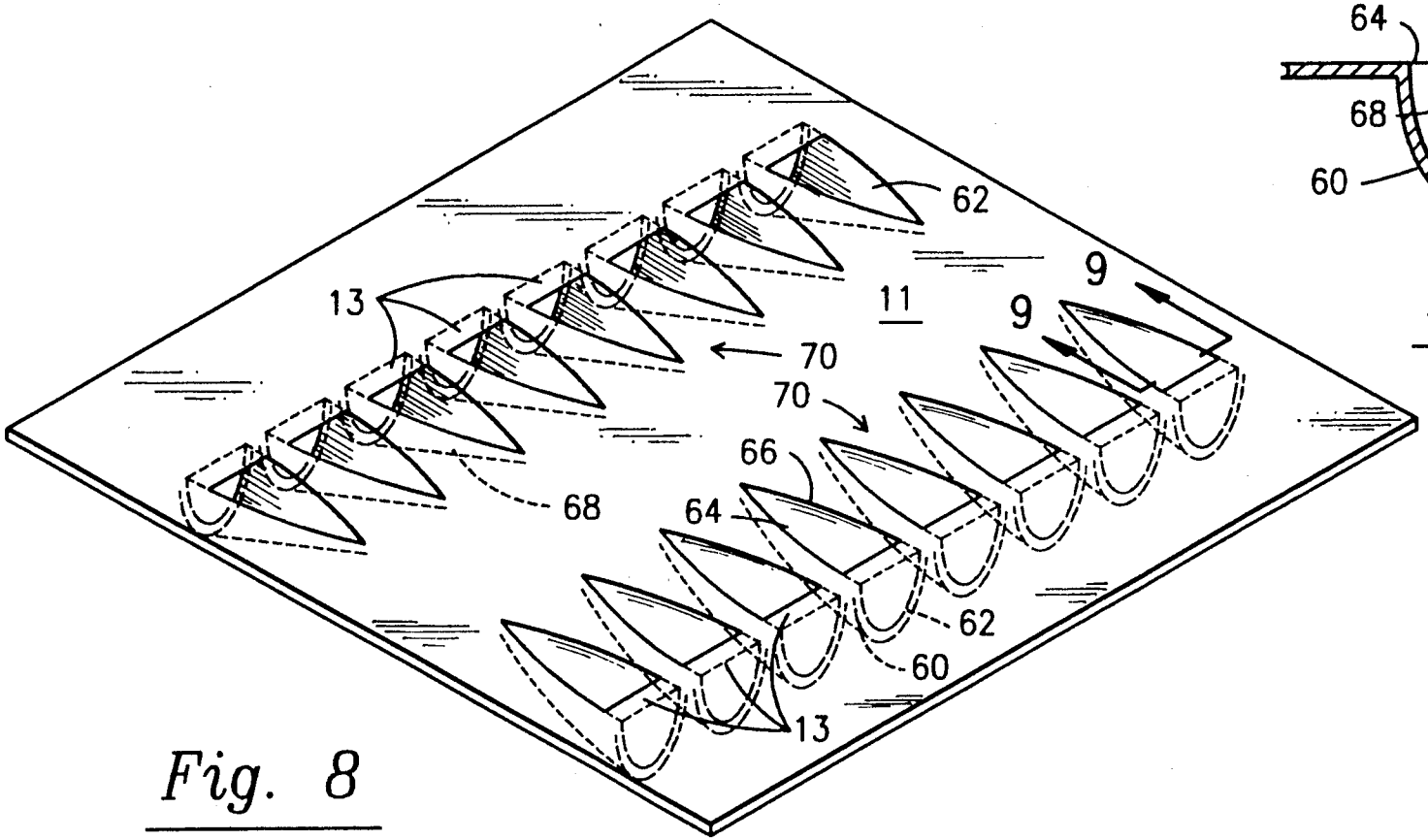
FIG. 8 is a perspective view of the third embodiment.

FIGS. 8 ad 9 show a third embodiment where the sidewalls 60, 62 are semicircular. More particularly, the sidewalls 60, 62 are generated by passing a plane, such as panel 11, through a cylinder passing through said plane at a predetermined angle, i.e., as in the first embodiment, and eliminating the parts above said plane. Blank off plate 13 is also provided in this embodiment.

Figure 9:
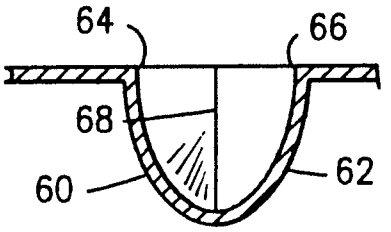
FIG. 9 is a sectional view taken along line 9—9 in FIG. 8.

Clearly, each nozzle could have a transverse section of any predetermined geometrical configuration, as is now obvious in view of this disclosure, i.e., any tubular or nontubular passageway of any cross section can be constructed so that only that part thereof below the plane of ceiling or panel 11 (or above the plane of any wall or floor, of course) is employed, all parts above said ceiling (or behind or below any wall or floor) being eliminated. All that is required is that the nozzle eject air at the optimal angle relative to the plane of the panel within which it is mounted, and that each nozzle be in fluid communication with its associated opening in said panel.

Where the cross sectional shapes of the sidewalls are changed, (which change of course changes the shape of the column of air produced by the nozzle), the triangular shape of opening 70 could be retained or changed. For example, in the embodiment of FIGS. 8 and 9, the shape of opening 70 could theoretically remain triangular or it could be changed to parabolic as shown. It should be understood that, for ease of fabrication purposes, the transverse shape of the nozzle will determine the shape of the opening 70.

Figure 11:
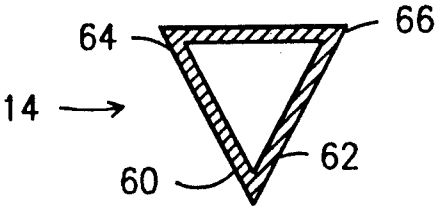
FIG. 11 is a sectional view taken along line 11—11 in FIG. 10.
Figure 10:
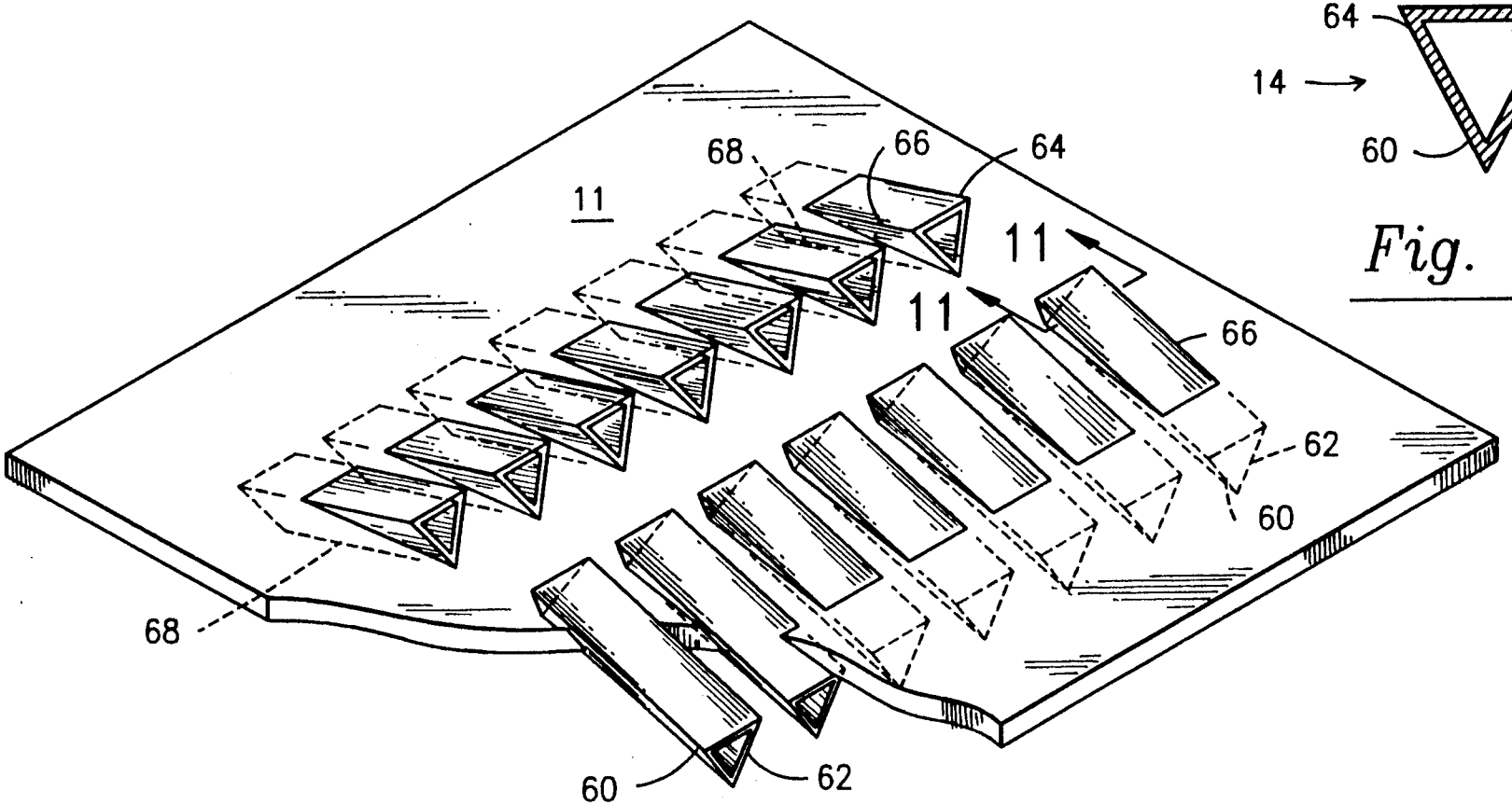
FIG. 10 is a perspective view of the fourth embodiment.

FIGS. 10 and 11 depict the fourth embodiment. By comparing said FIGS. with FIG. 3, it will be apparent that this fourth embodiment is created by inverting the nozzles of the first embodiment. By positioning flat bottom wall 30 toward the ceiling, the coanda effect is enhanced.

The essence of the invention is the opening 70 of any predetermined configuration formed in ceiling, wall, or floor 11, and at least one nozzle depending form said opening at a predetermined angle, said at least one nozzle having any predetermined cross section. Whether or not the nozzles penetrate the plane of the ceiling is not critical.

This invention is clearly new and useful. Moreover, it was not obvious to those or ordinary skill in this art at the time it was made, in view of the prior art considered as a whole as required by law.

This invention pioneers the art of ceiling, wall, or floor-penetrating air diffusers. Accordingly, the claims that follow are entitled to broad interpretation, as a matter of law, to protect form piracy the heart or essence of this breakthrough invention. This invention also pioneers the art of diffusers having angularly disposed nozzles that do not penetrate the plane of a ceiling, wall, or floor.

It will thus be seen that the objects set forth above, and those made apparent form the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. An air diffuser, comprising:

at least one nozzle;

said at least one nozzle having a predetermined length and a transverse section of predetermined configuration;

said at least one nozzle being disposed at a predetermined angle relative to a horizontal plane;

said predetermined angle being about eleven degrees;

said at least one nozzle having a leading end and a trailing end;

said at least one nozzle being mounted in penetrating relation to a ceiling means with said leading end being disposed above the plane of the ceiling means and said trailing end being disposed below said plane;

air delivery means for delivering air to said leading end of said at least one nozzle;

said air delivery means including a hollow housing disposed above the plane of said ceiling means in housing relation to said leading end, said hollow housing being in open fluid communication with a source of air to be introduced into said space, said air being under positive pressure;

said predetermined configuration of said transverse section of said at least one nozzle being triangular and wherein said at least one nozzle has an elongate, flat bottom wall and a pair of flat sidewalls that project upwardly therefrom in converging relation to one another, said flat bottom wall and said flat sidewalls being arranged to form said transverse section;

whereby said at least one nozzle injects a column of air into a space to be conditioned, said column of air having a transverse section determined by the transverse section of said at least one nozzle and said column of air entraining a maximum amount of ambient air in its wake due to the predetermined configuration of said transverse section and said predetermined angle so that said entrained air and said column of air are efficiently diffused into said space with minimum energy expenditure.

2. An air diffuser, comprising:

a plurality of nozzles;

each nozzle of said plurality of nozzles having a predetermined length and a transverse section of predetermined configuration;

each nozzle of said plurality of nozzles being disposed at a common predetermined angle relative to a horizontal plane;

said common predetermined angle being about eleven degrees;

each nozzle of said plurality of nozzles having a leading end and a trailing end;

each nozzle of said plurality of nozzles being mounted in penetrating relation to a ceiling means with its leading end being disposed above the plane of the ceiling means and its trailing end being disposed below said plane; and air delivery means for delivering air to the leading end of each nozzle of said plurality of nozzles;

said air delivery means including a hollow housing disposed above the plane of said ceiling means in housing relation to each leading end, said hollow housing being in open fluid communication with a source of air to be introduced into said hollow space, said air being under positive pressure; and the predetermined configuration of said transverse section of each nozzle of said plurality of nozzles being triangular and wherein each nozzle has an elongate, flat bottom wall and a pair of flat sidewalls that project upwardly therefrom in converging relation to one another, said flat bottom wall and said flat sidewalls being arranged to form said triangular section;

whereby each nozzle of said plurality of nozzles injects a column of air into a space to be conditioned, each column of air having a transverse section determined by the transverse section of its associated nozzle and each column of air entraining a maximum amount of ambient air into its wake due to the predetermined configuration of said transverse section and said predetermined angle so that each column of air is efficiently diffused into said space with minimum energy expenditure.

3. An air diffuser, comprising:

a panel member;

at least one triangular-in-configuration opening formed in said panel member;

said at least one opening having a predetermined length;

at least one nozzle;

said at least one nozzle having a predetermined length substantially equal to the predetermined length of said at least one opening;

said at least one nozzle having a pair of triangular-in-configuration sidewalls;

each of said sidewalls being flat and depending from opposite sides of said opening and being disposed in converging relation to one another;

said sidewalls meeting along a common elongate apex of said predetermined length; and said apex being disposed at a predetermined angle relative to the plane of said panel member.

4. The diffuser of claim 3, further comprising means for blanking off a preselected part of said at least one opening to provide definition to a column of air ejected by said at least one nozzle.

5. The diffuser of claim 3, wherein said predetermined angle is about eleven degrees.

6. The diffuser of claim 3, wherein each of said sidewalls has the configuration of a right triangle.

* * * * *